United States Patent [19]

Hurwitz

[11] Patent Number: 4,651,606

[45] Date of Patent: Mar. 24, 1987

[54] REVERSIBLE NON-ADJUSTABLE MITER GUIDE FOR TABLE SAWS

[76] Inventor: Abraham Hurwitz, 10 E. Gate La., Hamden, Conn. 06514

[21] Appl. No.: 837,189

[22] Filed: Mar. 7, 1986

[51] Int. Cl.[4] ..... B27B 27/10

[52] U.S. Cl. ..... 83/437; 83/477.2; 83/581

[58] Field of Search ..... 83/477.2, 437, 435.1, 83/431, 467, 581

[56] References Cited

U.S. PATENT DOCUMENTS

| | | | |
|---|---|---|---|
| 2,881,812 | 4/1959 | Alumbaugh et al. . | |
| 3,285,303 | 11/1966 | Kwiatkowski | 83/477.2 |
| 4,123,955 | 11/1978 | Marlow | 83/435.1 |
| 4,281,570 | 8/1981 | Hill | 83/477.2 |
| 4,317,562 | 3/1982 | Thibodaux | 269/304 |
| 4,367,668 | 1/1983 | Jensen | 83/435.1 X |

*Primary Examiner*—James M. Meister

*Attorney, Agent, or Firm*—H. Gibner Lehmann; K. Gibner Lehmann

[57] ABSTRACT

The invention provides a reversible non-adjustable miter guide having a pair of spaced-apart back-to-back parallel runner means each of which is adapted to closely slide in either of two guide grooves in a saw table, and at least one miter fence and preferably two, attached to said runner means and extending laterally thereof within parallel planes defined by the runner means. The miter guide can be economically fabricated of hardwood strips cemented together, or else molded or cast as a single unitary piece, in plastic or metal such as aluminum or zinc.

16 Claims, 9 Drawing Figures

Fig. 1
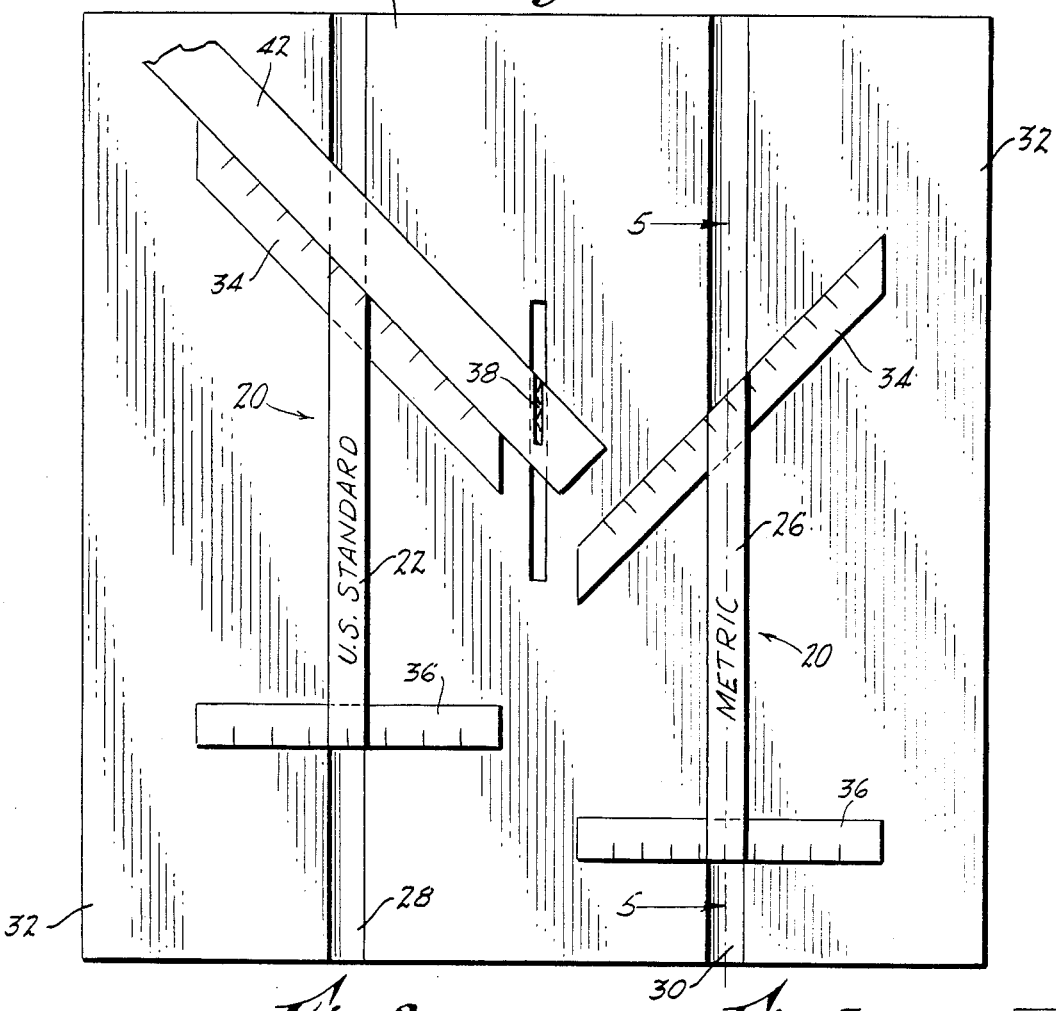
Fig. 2
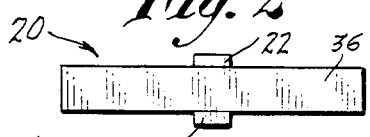
Fig. 3
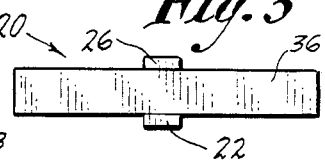
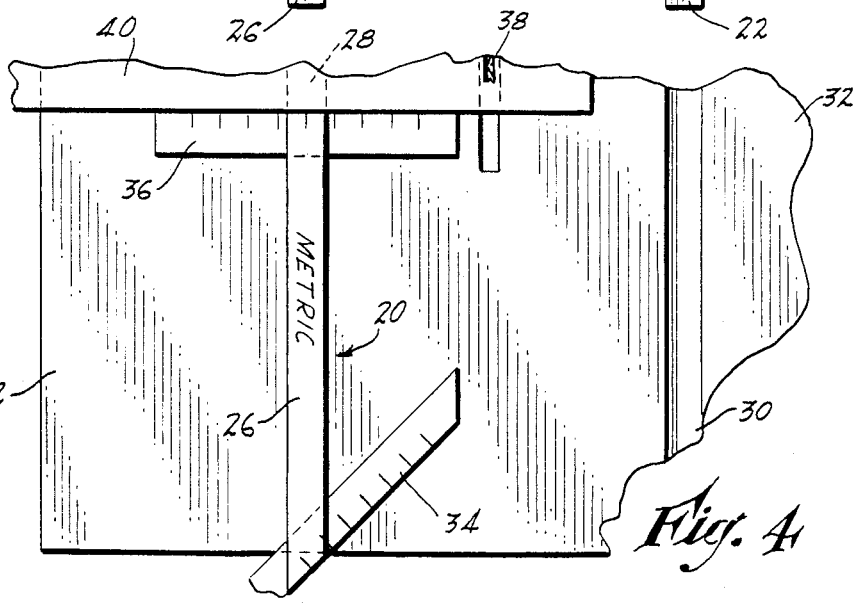
Fig. 4
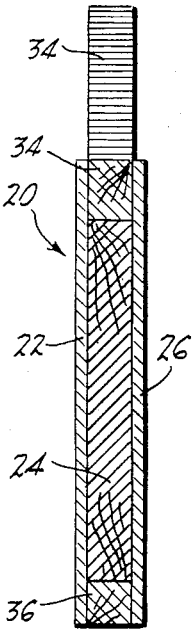
Fig. 5

54
46
46
56
56
48
50
48

46
62
60
64
50
48
62
66

62a
62a
64a
64a
66a
68
54
52
56
58
44
54
50
58
56
46
46
68
7
7
50
62
8
66
62
60
66
70
70
64
8
64

REVERSIBLE NON-ADJUSTABLE MITER GUIDE FOR TABLE SAWS

NO CROSS REFERENCES TO RELATED APPLICATIONS

Statement as to Rights to Inventions made under Federally-Sponsored Research and Development Research and development of the present invention and application have not been Federally-sponsored, and no rights are given under any Federal program.

BACKGROUND OF THE INVENTION

1. Field of the Invention

This invention relates to miter guides for table saws, and more particularly to non-adjustable guides of the type which slide in grooves provided in the table parallel to the plane of the saw blade.

2. Description of the Related Art Including Information Disclosed under 37 CFR §§1.97–1.99

U.S. Pat. Nos. 2,881,812; 3,285,303 and 4,317,562 show fixed miter guides. In U.S. Pat. No. 2,881,812 the miter guide has upstanding spaced guide plates at opposite edges of rectangular base plates, and has oblique guide heads affixed to the upper surfaces of the base plates. By its nature, the assemblage can only be used with its top side uppermost on the saw blade, and cannot be reversed for use with its bottom side uppermost.

U.S. Pat. No. 3,285,303 has a miter guide with upstanding 90° and 45° miter fences respectively, affixed to the upper side of a runner strip adapted to slide in the groove of the saw table. Such assemblage also can only be used with its top side uppermost on the saw table, and cannot be reversed for use with its bottom side uppermost.

U.S. Pat. No. 4,317,562 has a miter guide with upstanding 90° and 45° miter fences respectively, affixed to the upper side of a slotted base plate. This assemblage as well can only be used with its top side uppermost on the saw table, and cannot be reversed for use with its bottom side uppermost.

The devices of the first and third of the foregoing identified patents are, moreover, constituted of a number of separate components which in their fabrication and assembly, represent an appreciable cost. While the miter guide of U.S. Pat. No. 3,285,303 is relatively simple, its use is somewhat restricted by the necessity of utilizing the single runner means for all of the functions required.

SUMMARY OF THE INVENTION

The above disadvantages and drawbacks of prior miter guides for table saws are obviated by the present invention, which has for one object the provision of a novel and improved miter guide for table saws, which is reversible as to its top and bottom sides whereby its utility is greatly increased.

Another object of the invention is to provide an improved miter guide as above, which is non-adjustable whereby the 45° and 90° fences thereof are always precisely accurate as to their angles and placement.

A further object of the invention is to provide an improved miter guide in accordance with the foregoing, which is especially simple and economical in its construction, and which can be fabricated either in laminar fashion or else molded or cast as a single unitary piece.

A feature of the invention is the provision of an improved miter guide as above characterized, which has spaced-apart, parallel back-to-back runner means that rigidly mount the miter fences, such runner means comprising two independently functioning units either of which can be slidably received in the grooves of the saw table to put in use the miter fences.

Another feature of the invention is the provision of an improved miter guide as outlined, which is sturdy and durable, and capable of withstanding rough usage without the likelihood of breakage.

Other features and advantages will hereinafter appear.

In accomplishing the above objects the invention provides a reversible non-adjustable miter guide having a pair of spaced-apart back-to-back parallel runner means each of which is adapted to closely slide in either of two guide grooves in a saw table, and at least one miter fence and preferably two, attached to said runner means and extending laterally thereof within parallel planes defined by the runner means. The miter guide can be economically fabricated of hardwood strips cemented together, or else molded or cast as a single unitary piece, in plastic or metal such as aluminum or zinc.

BRIEF DESCRIPTION OF THE DRAWINGS

FIG. 1 is a top plan view of a standard type saw table having parallel guide grooves on opposite sides of the saw blade, and having the improved miter guide according to the invention shown in two positions, one as a top plan in one groove and holding a workpiece for a 45° cut, and the other as a bottom plan in the other groove.

FIG. 2 is an end elevation of the miter guide shown in top plan in FIG. 1.

FIG. 3 is an end elevation of the miter guide shown in bottom plan in FIG. 1.

FIG. 4 is a fragmentary top plan view of the saw table and miter guide, the latter holding a workpiece for a 90° cut.

FIG. 5 is a longitudinal section on the line 5—5 of FIG. 1.

FIG. 6 is a top plan view of a miter guide according to the invention, constituted as a single unitary piece.

DESCRIPTION OF THE PREFERRED EMBODIMENT

Figures 7, 8, 9:
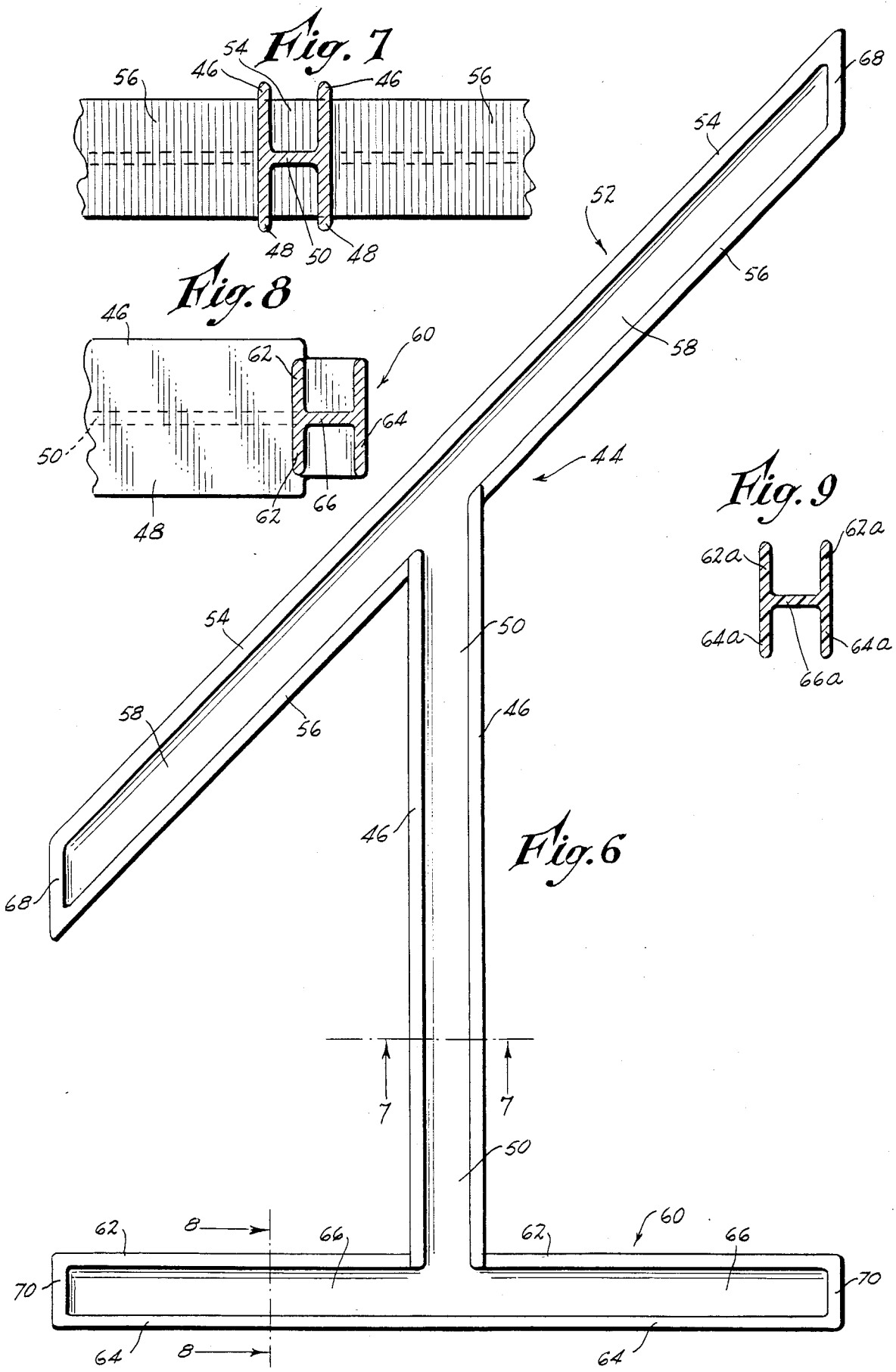
FIG. 7 is a transverse section taken on the line 7—7 of FIG. 6.
FIG. 8 is a transverse section taken on the line 8—8 of FIG. 6.
FIG. 9 is a fragmentary transverse section similar to that of FIG. 8 but showing the material of the guide as being of plastic.

Considering first the embodiment of the invention illustrated in FIGS. 1–5, the reversible non-adjustable miter guide shown therein is indicated generally by the numeral 20. As seen in FIG. 5 it is constituted of hardwood strips which are secured together in a laminar arrangement, preferably by an adhesive such as epoxy cement or other water-insoluble glue.

The guide comprises a runner means in the form of three superposed strips 22, 24 and 26, the strip 24 constituting a filler between the runner strips 22 and 26.

As seen in FIG. 1, the runner strips 22 and 26 are adapted to closely slide in the guide grooves 28 or 30 of the saw table 32. The strips 22 and 26 are seen to be spaced apart and arranged in back-to-back parallel relation, with the spacing being effected by the filler strip 24. Stated another way, each of said runner means 22 or 26 by itself is constituted to closely slide in either of the two guide grooves 28 or 30. It is readily seen that in the broader concept of the invention, each said runner means comprises an elongate structure having oppositely outwardly directed faces or edges for simultaneously engaging a pair of inwardly directed cooperable faces of a single one of the guide grooves 28, 30.

Affixed to the ends of the laminated runner means are miter fences 34 and 36, these being preferably interposed between end portions of the strips 22 and 26. The miter fence 34 is arranged at a 45° angle with respect to the runner means, and the miter fence 36 is arranged at a 90° angle with respect to the runner means.

In accordance with this invention, the arrangement of the back-to-back runner means and the miter fences is such that the entire miter guide can be reversibly applied to the saw table 32, as for instance in the position to the left of the saw blade 38 wherein the fence 34 extends downward and to the right, or else in the position shown to the right of the saw blade 38 wherein the fence 34 extends downward and to the left.

Also, the miter guide can be placed so that the 90° fence 36 is foremost, for making right-angle cuts. Such a cut is illustrated in FIG. 4 where a piece of molding 40 is being cut through by the saw blade 38.

In FIG. 1 a wooden workpiece or molding 42 is being cut by the blade 38 at a 45° angle. This same workpiece could be accurately cut at its other end at a 45° angle by merely flipping over the miter guide 20 and using it in the right groove 30 of the table. Or, after flipping over the miter guide it could still be placed in the left groove 28 of the table, as well. Thus, both left hand and right hand precise 45° cuts can easily be executed, with the assurance that when such cuts are made in separate pieces, the pieces can be joined perfectly to produce an accurate miter at 90°, with a tight joint.

It will be appreciated from the foregoing that the present improved one-piece non-adjustable miter guide is extremely versatile while at the same time insuring precise 45° cuts and perfect corner miters, as when making picture frames or fitting moldings for interior trim in a building.

Another embodiment of the invention is illustrated in FIGS. 6–8, wherein the reversible, non-adjustable miter guide 44 is constituted as a single integral piece. The guide 44 could be made as a plastic molding, or it could be a metal die stamping of zinc, aluminum or other suitable material. When made in plastic, it could have fibers incorporated to give it additional strength, if desired.

As shown, the miter guide 44 has runner means comprising spaced-apart parallel side flanges 46 and 48 which are connected by a center web 50. The 45° miter fence portion 52 of the guide comprises spaced-apart parallel side flanges 54 and 56 which are connected by a center web 58, and the 90° miter fence portion 60 of the guide has spaced-apart parallel side flanges 62 and 64 which are connected by a center web 66.

The 45° miter fence 52 has box ends or end walls 68, and the 90° miter fence has box ends or end walls 70, thereby providing a continuous outer wall surface constituted of the portions 46, 48, 54, 56, 62, 64, 68 and 70. Stated another way, the flanges 46, 48, 54, 56, 62 and 64 are all joined by virtue of the end walls 68 and 70 so as to form a continuous outer wall surrounding the center webs 50, 58 and 66 as can be readily seen. The guide of FIGS. 6–8 is shown as being of metal, although it could be molded of plastics material as aforementioned. FIG. 9 illustrates a section like that of FIG. 8 but cross-hatched for plastic substance. In FIG. 9, the runner means is constituted of the flanges **62*a* and 64*a* joined by the web 66*a***.

I have found that a reversible non-adjustable miter guide according to the present invention is an extremely useful adjunct in the shop, especially in the making of accurate miters for frames and the like, as well as miter corners for interior trim in a building. The non-adjustability is an important feature since the 45° and 90° angles of the fences will always be accurate and not likely to change. Thus, joints can be quickly cut and fitted with the assurance that a professional looking job will ensue.

Variations and modifications of the invention are possible without departing from the spirit of the invention.

Each and every one of the appended claims represents an inventive concept apart from the others, and each is to be considered separately when reviewing the prior art.

I claim:

1. A reversible miter guide for a table saw, comprising a pair of spaced-apart back-to-back parallel runner means, each said runner means by itself being constructed to closely slide in either of two guide grooves in a saw table, each said runner means comprising an elongate structure having oppositely outwardly directed faces for simultaneously engaging a pair of inwardly directed cooperable faces of a single one of said guide grooves of said saw table, and a miter fence attached to said runner means and extending laterally thereof within parallel planes defined by the runner means.

2. A reversible miter guide as set forth in claim 1, wherein the miter fence extends laterally in both of opposite directions from the runner means.

3. A reversible miter guide as set forth in claim 1, wherein the miter fence extends at an angle of 45° from the runner means.

4. A reversible miter guide as set forth in claim 1, wherein the miter fence extends at an angle of 90° from the runner means.

5. A reversible miter guide as set forth in claim 1, and including a second miter fence attached to said runner means at a point spaced from the first-mentioned miter fence, one of said fences extending at an angle of 45° from the runner means and the other fence extending at an angle of 90° from the runner means.

6. A reversible miter guide as set forth in claim 1, wherein said runner means and miter fence are constituted of hardwood strips joined by an adhesive.

7. A reversible miter guide as set forth in claim 1, wherein said runner means and miter fence are constituted as a one-piece molding of plastics material.

8. A reversible miter guide as set forth in claim 1, wherein said runner means and miter fence are constituted as a one-piece metal casting.

9. A reversible miter guide as set forth in claim 6, wherein the miter fence extends at an angle of 45° from the runner means.

10. A reversible miter guide as set forth in claim 7, wherein the miter fence extends at an angle of 45° from the runner means.

11. A reversible miter guide as set forth in claim 1, wherein said runner means and miter fence are constituted as a single integral piece.

12. A reversible miter guide as set forth in claim 11, wherein the miter fence extends at an angle of 45° from the runner means.

13. A reversible miter guide as set forth in claim 11, wherein the miter fence has an H-shaped cross-section.

14. A reversible miter guide as set forth in claim 12, wherein the miter fence has a box-shaped end.

15. A reversible miter guide as set forth in claim 11, wherein the back-to-back runner means has an H-shaped cross section.

16. A reversible miter fence as set forth in claim 11, wherein the miter fence and the runner means have H-shaped cross sections characterized by side flanges connected by center webs, said side flanges being joined to each other and said center webs being joined to each other.

* * * * *